US008998661B2

(12) United States Patent
Kinoshita

(10) Patent No.: US 8,998,661 B2
(45) Date of Patent: Apr. 7, 2015

(54) WATER JET PROPULSION BOAT

(71) Applicant: Yamaha Hatsudoki Kabushiki Kaisha, Iwata-shi, Shizuoka (JP)

(72) Inventor: Yoshimasa Kinoshita, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 59 days.

(21) Appl. No.: 13/903,109

(22) Filed: May 28, 2013

(65) Prior Publication Data

US 2013/0344754 A1 Dec. 26, 2013

(30) Foreign Application Priority Data

Jun. 20, 2012 (JP) ..... 2012-138555
Feb. 7, 2013 (JP) ..... 2013-022136

(51) Int. Cl.

| | |
|---|---|
| ***B63H 11/113*** | (2006.01) |
| ***B63H 21/21*** | (2006.01) |
| ***B63H 11/107*** | (2006.01) |
| ***F02D 29/02*** | (2006.01) |
| ***F02D 11/02*** | (2006.01) |
| ***F02D 41/02*** | (2006.01) |
| ***F02D 11/10*** | (2006.01) |
| *B63H 11/11* | (2006.01) |

(52) U.S. Cl.

CPC ..... *B63H 21/21* (2013.01); *B63H 11/107* (2013.01); *B63H 11/11* (2013.01); *F02D 29/02* (2013.01); *B63H 2021/216* (2013.01); *F02D 11/02* (2013.01); *F02D 41/021* (2013.01); *F02D 41/0225* (2013.01); *F02D 11/105* (2013.01); *F02D 2200/602* (2013.01)

(58) Field of Classification Search

USPC ..... 440/1, 38, 42
IPC ..... B63H 11/11,11/113
See application file for complete search history.

(56) References Cited

U.S. PATENT DOCUMENTS

| | | | | |
|---|---|---|---|---|
| 5,507,672 | A * | 4/1996 | Imaeda | 440/1 |
| 5,755,601 | A | 5/1998 | Jones | |
| 7,708,609 | B2 * | 5/2010 | Plante et al. | 440/41 |

* cited by examiner

*Primary Examiner* — Stephen Avila
(74) *Attorney, Agent, or Firm* — Keating & Bennett, LLP

(57) ABSTRACT

A water jet propulsion boat includes a boat body, an engine, a jet propulsion mechanism, a first accelerator operation section, a second accelerator operation section, a reverse gate, and a control section. The engine is accommodated in the boat body. The jet propulsion mechanism generates a propulsion power using a drive power from the engine. The reverse gate is arranged to move to a first position and to a second position. The boat body advances when the reverse gate is in the first position. The reverse gate reduces the propulsion power which advances the boat body when the reverse gate is in the second position. The control section is programmed to set the position of the reverse gate and a throttle opening of the engine based on an operation amount of the first accelerator operation section and an operation amount of the second accelerator operation section.

17 Claims, 7 Drawing Sheets

WATER JET PROPULSION BOAT

BACKGROUND OF THE INVENTION

1. Field of the Invention

The present invention relates to a water jet propulsion boat.

2. Description of the Related Art

A water jet propulsion boat generates propulsion power in a boat body using a jet of water from a water jet propulsion mechanism. The water jet propulsion boat is provided with a reverse gate which changes the orientation of the jet of water. It is possible for the reverse gate to be moved to, for example, a forward position or a reverse position. The reverse gate changes the orientation of the jet of water to the front of the boat body in the reverse position. Due to this, the boat body reverses. Alternatively, the speed of the boat body in the forward direction is reduced.

It is necessary for the movement of the reverse gate to be performed after the propulsion power of the water jet propulsion mechanism has been sufficiently reduced. For example, a vessel which is disclosed in U.S. Pat. No. 7,708,609 is controlled so that, when the rotation speed of the engine is larger than a predetermined rotation speed when a lever is being operated, the rotation speed of the engine is reduced so that the rotation speed of the engine is equal to or less than the predetermined rotation speed, and after that, the reverse gate is moved. Alternatively, in a personal water craft (PWC) which is disclosed in U.S. Pat. No. 5,755,601, the position of the reverse gate is set based on an operation signal from both a throttle lever and a brake lever. In the PWC, the reverse gate is set at either a forward position, a reverse position, or a neutral position according to a combination of the presence or absence of the operation of the throttle lever and the brake lever.

In the vessel which is disclosed in U.S. Pat. No. 7,708,609, the rotation speed of the engine is reduced without relation to the lever operation amount. As a result, it is not possible to obtain a natural speed reduction performance according to the lever operation amount. In the same manner, in the PWC disclosed in U.S. Pat. No. 5,755,601, it is not possible to obtain a natural speed reduction performance according to the brake lever operation amount.

SUMMARY OF THE INVENTION

Preferred embodiments of present invention provide a water jet propulsion boat in which it is possible to obtain a natural speed reduction performance according to an operation by an operator of the water jet propulsion boat.

A water jet propulsion boat according to a preferred embodiment of the present invention includes a boat body, an engine, a jet propulsion mechanism, a first accelerator operation section, a second accelerator operation section, a reverse gate, and a control section. The engine is accommodated in the boat body. The jet propulsion mechanism generates a propulsion power using a drive power from the engine. The reverse gate is arranged to move to a first position and to a second position. The reverse gate advances the boat body forward when the reverse gate is in the first position. The reverse gate reduces the propulsion power which advances the boat body forward when the reverse gate is in the second position. The control section is programmed to set the position of the reverse gate and the throttle opening of the engine based on the operation amount of the first accelerator operation section and the operation amount of the second accelerator operation section.

In the water jet propulsion boat according to the present preferred embodiment of the present invention, the position of the reverse gate and the throttle opening of the engine are set based on the operation amount of the first accelerator operation section and the operation amount of the second accelerator operation section. Thus, it is possible to obtain a natural speed reduction performance according to an operation by an operator of the water jet propulsion boat.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
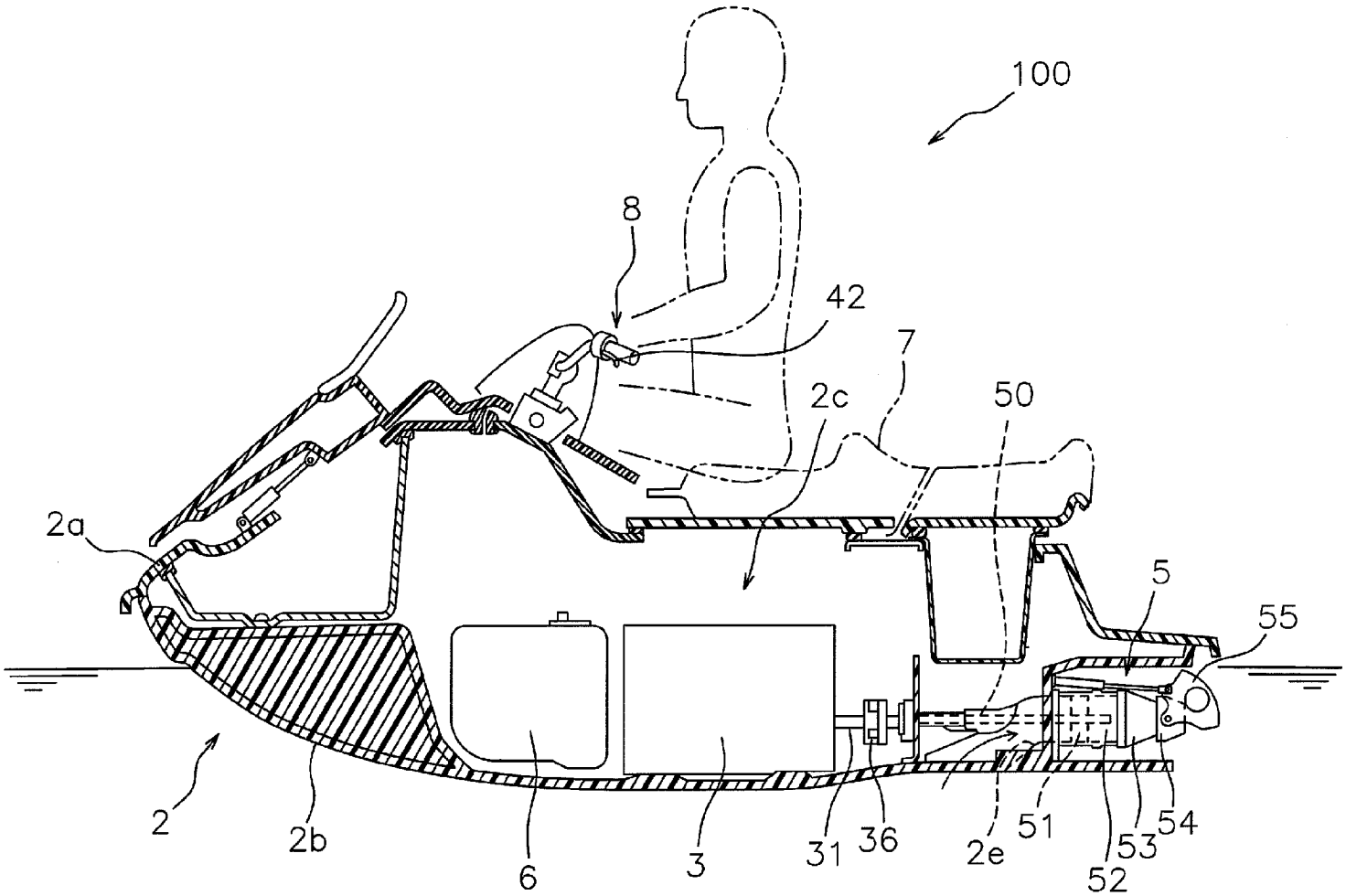
FIG. 1 is a cross-sectional diagram illustrating an outline configuration of a water jet propulsion boat according to a preferred embodiment of the present invention.
Figure 2:
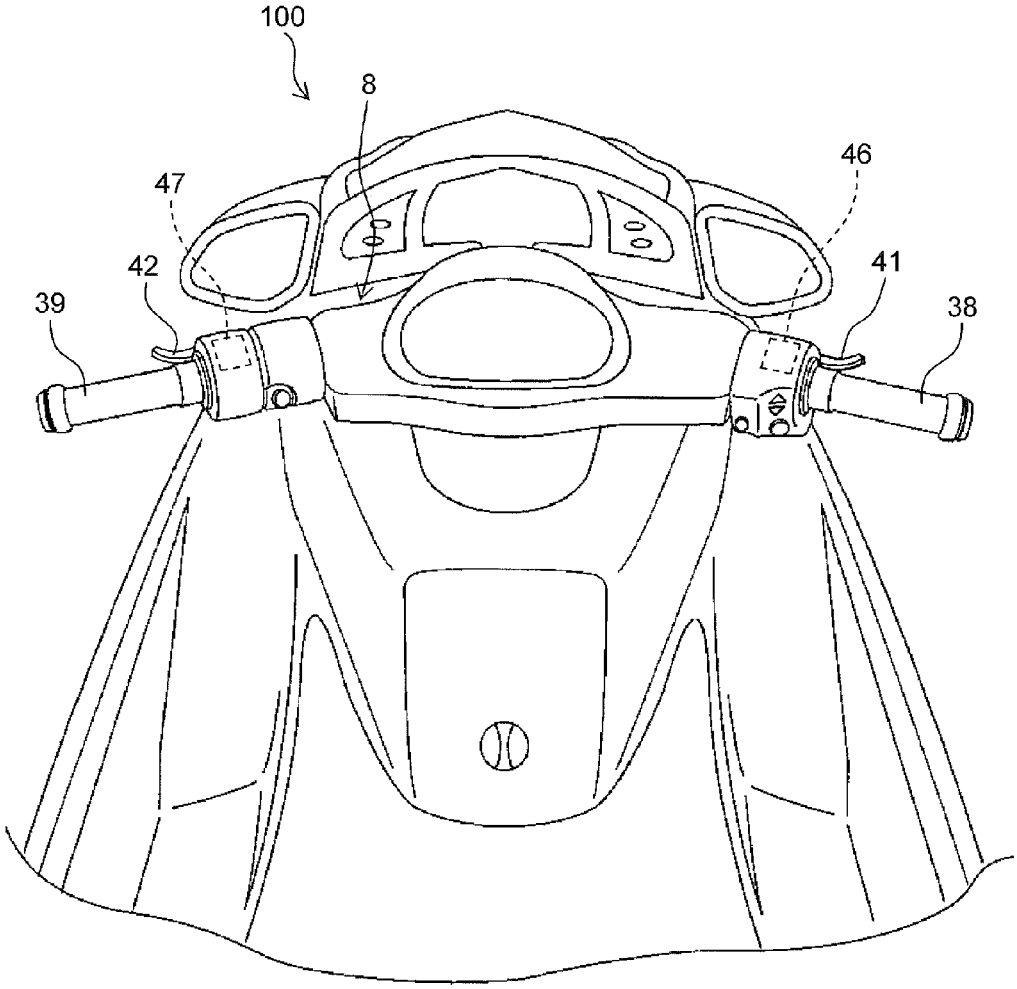
FIG. 2 is a perspective diagram illustrating a configuration in the vicinity of a steering handle of the water jet propulsion boat.
Figure 3:
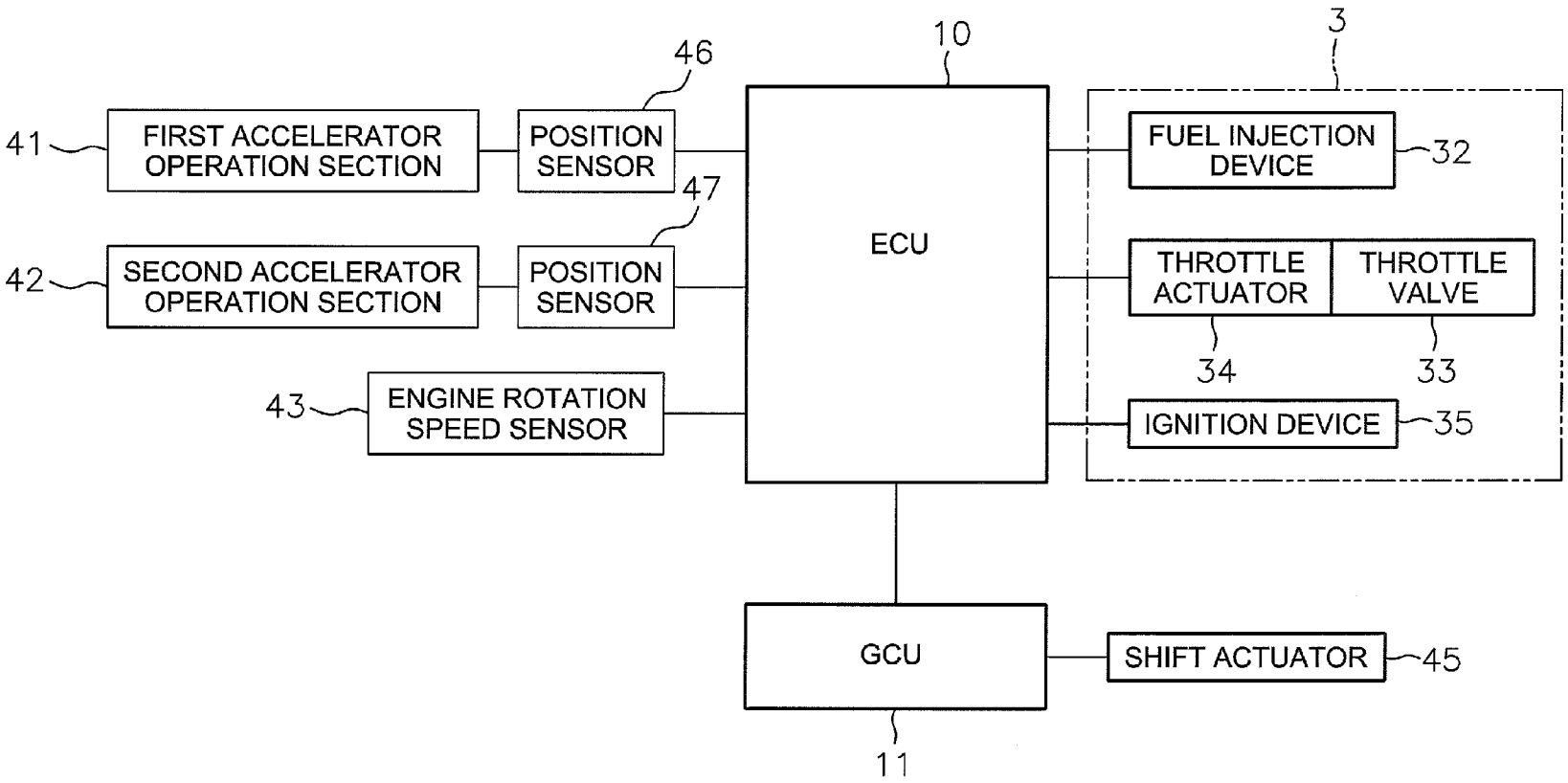
FIG. 3 is a block diagram illustrating a control system of the water jet propulsion boat.

A water jet propulsion boat according to preferred embodiments of the present invention will be described below with reference to the drawings. FIG. 1 is a cross-sectional diagram illustrating an outline configuration of a water jet propulsion boat 100 according to a preferred embodiment of the present invention. FIG. 2 is a perspective diagram illustrating a configuration in the vicinity of a steering handle 8 of the water jet propulsion boat 100. FIG. 3 is a block diagram illustrating a control system of the water jet propulsion boat 100. The water jet propulsion boat 100 is preferably a so-called personal water craft (PWC), for example.

As shown in FIG. 1, the water jet propulsion boat 100 includes a boat body 2, an engine 3, and a jet propulsion mechanism 5. The boat body 2 includes a deck 2*a* and a hull 2*b*. An engine room 2*c* is provided in the interior of the boat body 2. The engine room 2*c* accommodates the engine 3, a fuel tank 6, and the like. A seat 7 is attached to the deck 2*a*. The seat 7 is disposed above the engine 3. The steering handle 8 to steer the boat body 2 is disposed in front of the seat 7.

As shown in FIG. 2, the steering handle 8 includes a right grip 38 and a left grip 39 for an operator to hold when steering. A first accelerator operation section 41 is provided in the right grip 38 and is arranged to rotate. The first accelerator operation section 41 is mainly operated in order to advance the water jet propulsion boat 100. In this preferred embodiment, the first accelerator operation section 41 is preferably a lever, for example. A position sensor 46 is connected to the first accelerator operation section 41. The position sensor 46 outputs a signal, which indicates an operation amount of the first accelerator operation section 41 (referred to below as "first accelerator operation amount"), to an ECU 10 shown in FIG. 3.

In addition, a second accelerator operation section 42 is provided in the left grip 39 and arranged to rotate. The second accelerator operation section 42 is mainly operated in order to reverse the water jet propulsion boat 100 or in order to reduce the forward speed of the water jet propulsion boat 100. In this preferred embodiment, the second accelerator operation section 42 is preferably a lever. A position sensor 47 is connected to the second accelerator operation section 42. The position sensor 47 outputs a signal, which indicates an operation amount of the second accelerator operation section 42 (referred to below as "second accelerator operation amount"), to the ECU 10.

The engine 3 includes a crank shaft 31. The crank shaft 31 is disposed so as to extend in the front and back direction. As shown in FIG. 3, the engine 3 includes a fuel injection device 32, a throttle valve 33, a throttle actuator 34, and an ignition device 35. The fuel injection device 32 injects fuel into the combustion chamber of the engine 3. By changing the opening of the throttle valve 33 (referred to below as "throttle opening"), the amount of the air fuel mixture which is sent to the combustion chamber is adjusted. The throttle valve 33 is arranged to be shared with regard to a plurality of the cylinders of the engine 3. Alternatively, a throttle valve 33 can be provided for each of the cylinders in the engine 3. The throttle actuator 34 changes the throttle opening. The ignition device 35 ignites the fuel in the combustion chamber. Although not shown in FIG. 3, the fuel injection device 32 and the ignition device 35 are provided for each of the cylinders in the engine 3.

The jet propulsion mechanism 5 generates a propulsion power which advances the boat body 2 forward using the drive power from the engine 3. The jet propulsion mechanism 5 ejects water by sucking in water from the surroundings of the boat body 2. As shown in FIG. 1, the jet propulsion mechanism 5 includes an impeller shaft 50, an impeller 51, an impeller housing 52, a nozzle 53, a deflector 54, and a reverse gate 55. The impeller shaft 50 is disposed so as to extend from the engine room 2*c* to the rear of the water jet propulsion boat 100. A front portion of the impeller shaft 50 is linked to the crank shaft 31 via a coupling section 36. A rear portion of the impeller shaft 50 extends into the impeller housing 52 via a water suction section 2*e* of the boat body 2. The impeller housing 52 is connected to a rear portion of the water suction section 2*e*. The nozzle 53 is disposed to the rear of the impeller housing 52. The impeller 51 is attached to the rear of the impeller shaft 50. The impeller 51 is disposed in the interior of the impeller housing 52. The impeller 51 rotates together with the impeller shaft 50 and sucks in water from the suction section 2*e*. The impeller 51 ejects water, which has been sucked in, from the nozzle 53 to the rear of the water jet propulsion boat 100. The deflector 54 is disposed on the rear of the nozzle 53. The deflector 54 is configured so as to switch the ejecting direction of the water from the nozzle 53 to the left and to the right.

The reverse gate 55 is disposed to the rear of the deflector 54. The reverse gate 55 is configured so that it is possible to switch the ejecting direction of the water from the nozzle 53 and the deflector 54 to the front. Specifically, the reverse gate 55 is provided so that movement between a forward position, a reverse position, and a neutral position is possible. The reverse gate 55 in the forward position does not change the orientation of the jet of water from the jet propulsion mechanism 5. Accordingly, the boat body 2 advances forward when the reverse gate 55 is in the forward position. The reverse gate 55 in the reverse position changes the orientation of the jet of water from the jet propulsion mechanism 5 toward the front of the boat body 2. Accordingly, the reverse gate 55 in the reverse position reverses the boat body 2. Alternatively, the reverse gate 55 in the reverse position reduces the propulsion power which advances the boat body 2 forward. Thus, the speed of the boat body 2 is reduced. The neutral position is a position between the forward position and the reverse position. The reverse gate 55 in the neutral position changes the orientation of the jet of water from the jet propulsion mechanism 5 to the right or to the left. Accordingly, the reverse gate 55 in the neutral position reduces the propulsion power which advances the boat body 2 forward. Thus, the speed of the boat body 2 is reduced.

As shown in FIG. 3, the water jet propulsion boat 100 includes an engine rotation speed sensor 43 and an ECU 10 (Engine Control Unit). The engine rotation speed sensor 43 detects the rotation speed of the engine. A speed signal which shows the rotation speed of the engine is input into the ECU 10.

The ECU 10 is programmed to control the engine 3. That is, by sending an instruction signal to the fuel injection device 32, the throttle actuator 34, and the ignition device 35, the ECU 10 electronically controls these devices. By controlling the fuel injection device 32, the ECU 10 controls the amount of fuel which is supplied to the combustion chamber of the engine 3. By driving the throttle actuator 34, the ECU 10 controls the throttle opening. The ECU 10 increases and decreases the rotation speed of the engine by controlling the throttle opening according to the first accelerator operation amount.

As shown in FIG. 3, the water jet propulsion boat 100 includes a shift actuator 45 and a GCU 11 (Gate Control Unit). The shift actuator 45 moves the reverse gate 55 to either the forward position, the reverse position, or the neutral position. For example, the shift actuator 45 is preferably a servo motor and is controlled by the GCU 11. The GCU 11 is programmed to change the position of the reverse gate 55 by controlling the shift actuator 45 according to the operation of the first accelerator operation section 41 and the operation of the second accelerator operation section 42.

Figure 4:
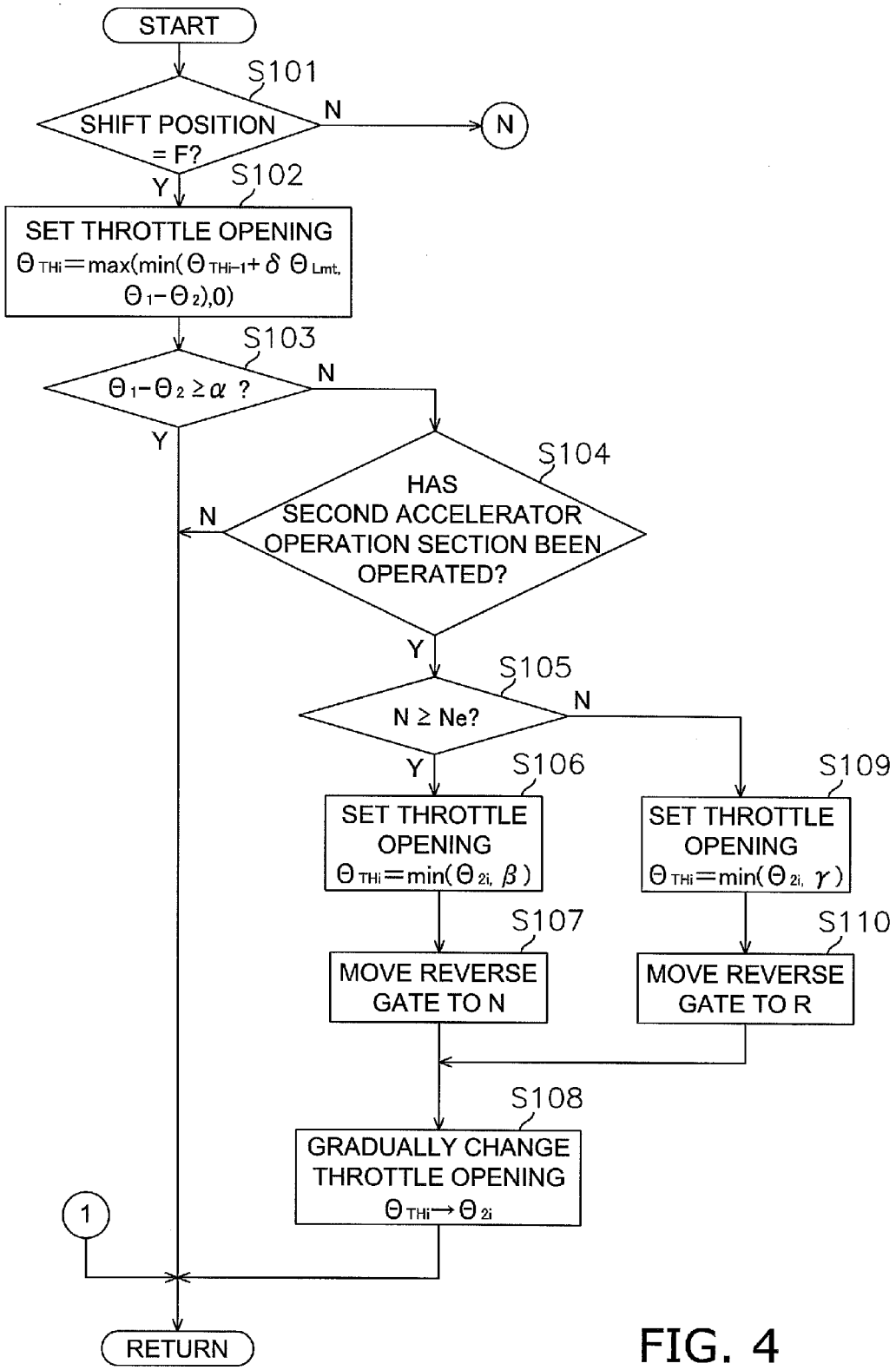
FIG. 4 is a flow chart illustrating a process of controlling the speed reduction.
Figure 5:
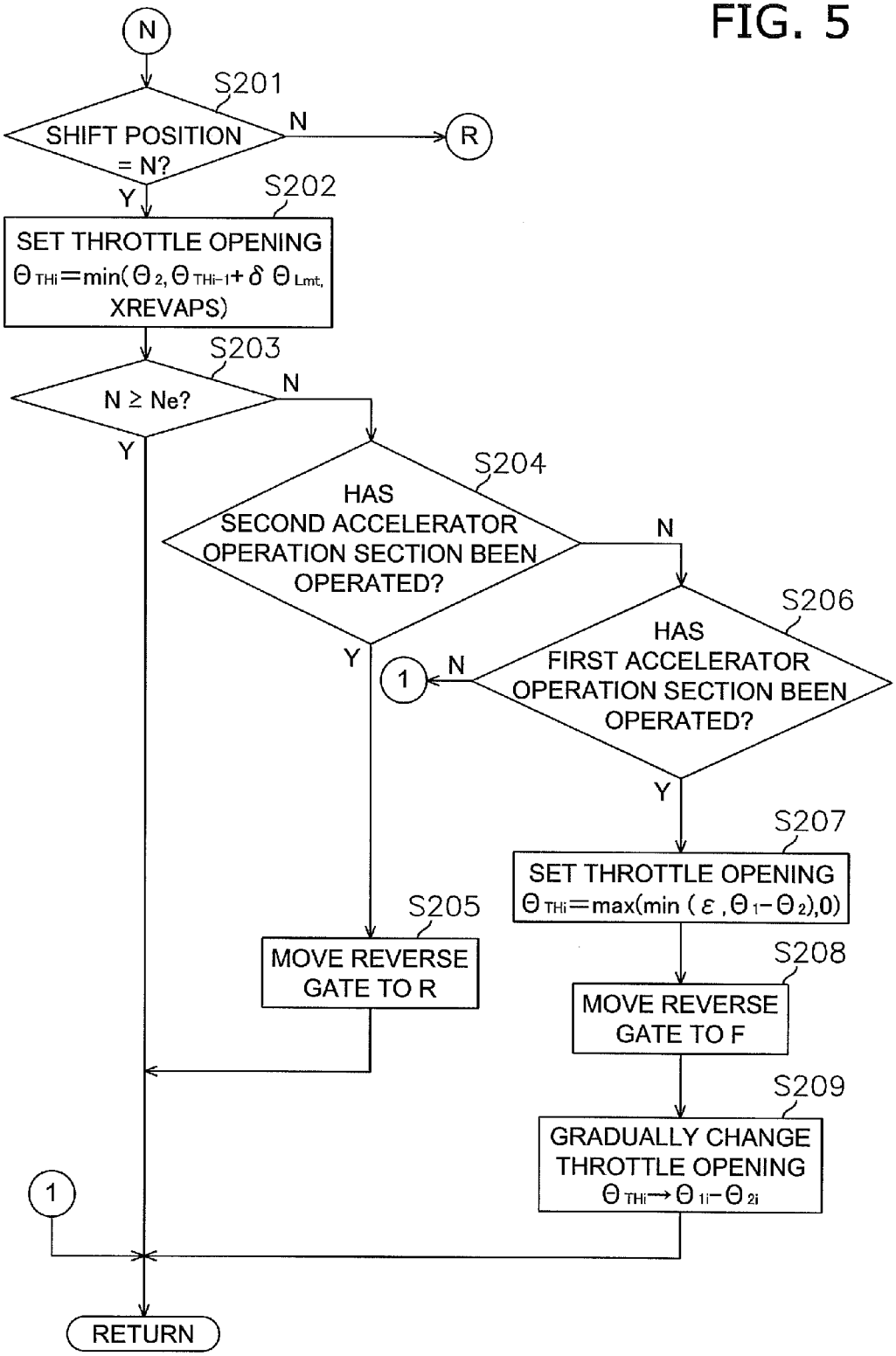
FIG. 5 is a flow chart illustrating a process of controlling the speed reduction.
Figure 6:
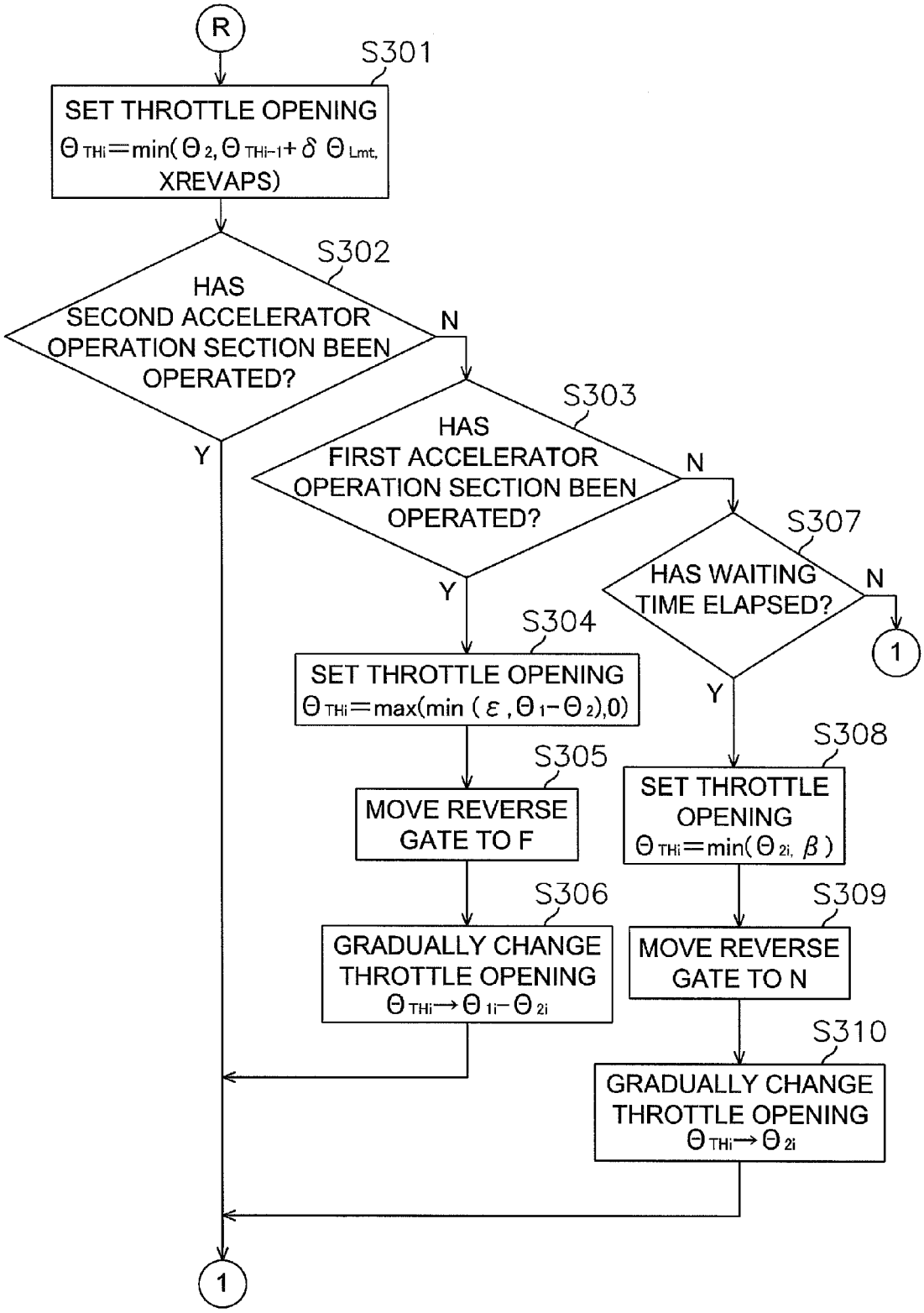
FIG. 6 is a flow chart illustrating a process of controlling the speed reduction.

The ECU 10 is programmed to execute a speed reduction control which reduces the speed of the boat body 2 according to the first accelerator operation amount and the second accelerator operation amount. In the speed reduction control, the ECU 10 is programmed to set the position of the reverse gate 55 and the throttle opening of the engine 3 based on the first accelerator operation amount and the second accelerator operation amount. Below, the speed reduction control is described based on FIG. 4 to FIG. 6. FIG. 4 to FIG. 6 are flow charts illustrating a process of controlling the speed reduction which is executed using the ECU 10.

In step S101, the ECU 10 determines whether or not the shift position is "F". The shift position means the position of the reverse gate 55 and "F" means the forward position. For example, the GCU 11 determines the shift position based on a signal from a sensor which detects the position of the reverse gate 55.

When the shift position is "F" in step S101, the process progresses to step S102. When the shift position is not "F" in step 101, the process progresses to step S201 shown in FIG. 5.

In step S102, the ECU 10 is programmed to set a throttle opening ΘTHi. The ECU 10 sets a value from the highest value selected from the smallest value of "ΘTHi−1+δΘLmt", "Θ1−Θ2", and zero as the throttle opening ΘTHi. ΘTHi−1 is the previous throttle opening. The δΘLmt is an upper limit level of the amount of one incremental change of the throttle opening being increased and is set in advance. Accordingly, "Θ1−Θ2" is set as ΘTHi when "Θ1−Θ2" does not exceed "ΘTHi−1+δΘLmt". Here, ΘTHi is set at zero when "Θ1−Θ2" is smaller than zero.

Figure 7:
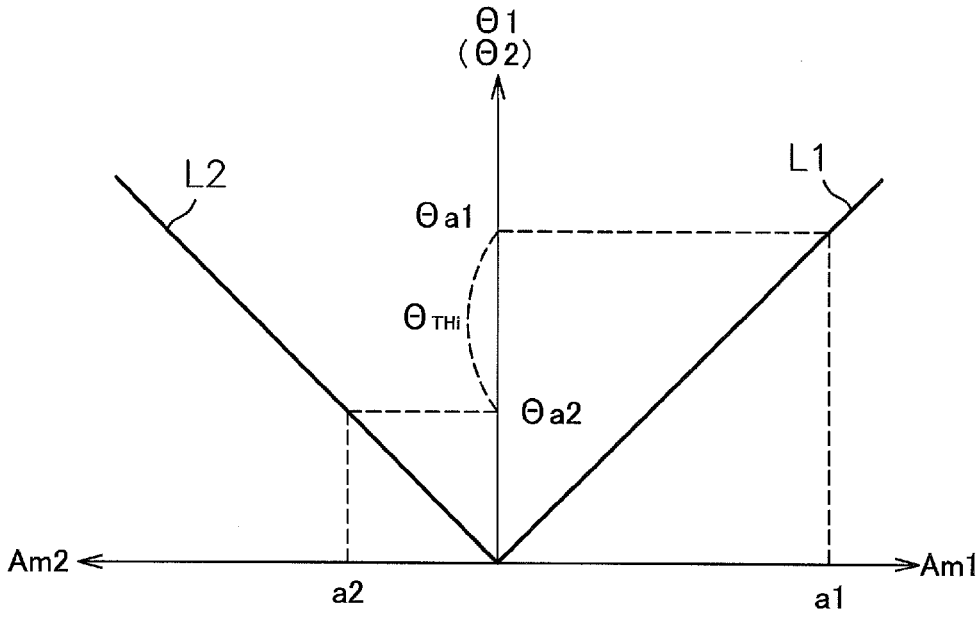
FIG. 7 is a diagram illustrating an example of throttle opening information.

Θ1 is the throttle opening according to the first accelerator operation amount. As shown in FIG. 7, the ECU 10 stores first throttle opening information L1 which specifies the relationship between a first accelerator operation amount Am1 and the throttle opening Θ1 according to the first accelerator operation amount Am1. The ECU 10 is programmed to calculate the throttle opening Θ1 according to the first accelerator operation amount Am1 from the first accelerator operation amount Am1 based on the first throttle opening information L1. Θ2 is the throttle opening according to the second acceleration operation amount. As shown in FIG. 7, the ECU 10 stores second throttle opening information L2 which specifies the relationship between the second acceleration operation amount Am2 and the throttle opening Θ2 according to the second acceleration operation amount Am2. The ECU 10 is programmed to calculate the throttle opening Θ2 according to the second acceleration operation amount Am2 from the second acceleration operation amount Am2 based on the second throttle opening information L2.

For example, Θ1 is Θa1 and Θ2 is Θa2 when the first accelerator operation amount Am1 is a1 and the second acceleration operation amount Am2 is a2. Accordingly, "Θa1−Θa2" is set as ΘTHi when "Θa1−Θa2" does not exceed "ΘThi−1+δΘLmt". Here, ΘTHi is set at zero when "Θ1−Θ2" is smaller than zero. When the "Θa1−Θa2" exceeds "ΘTHi−1+δΘLmt", "ΘTHi−1+δΘLmt" is set at ΘTHi.

As described above, when the reverse gate 55 is at the forward position, the throttle opening is set according to the difference between the first accelerator operation amount and the second accelerator operation amount. Here, when the difference between the first accelerator operation amount and the second accelerator operation amount is large, the throttle opening is limited to "ΘTHi−1+δΘLmt". The ECU 10 is programmed to control the throttle actuator 34 so that the throttle opening is ΘTHi which is set in step S104.

In step S103, the ECU 10 determines whether or not the difference between Θ1 and Θ2 is equal to or more than a predetermined value "α". Here, the absolute value of α is a value which is extremely small. When the difference between Θ1 and Θ2 is equal to or more than the predetermined value "α", the process returns to step S101. When the difference between Θ1 and Θ2 is less than the predetermined value "α", the process progresses to step S104. The difference between Θ1 and Θ2 being less than the predetermined value "α" means that the operator is attempting to reduce the speed of the boat body 2. Accordingly, when the difference between Θ1 and Θ2 is less than the predetermined value "α", a process is executed from step S104 and beyond so that the speed of the boat body 2 is reduced by moving the reverse gate 55 from the forward position to the reverse position or to the neutral position.

In step S104, the ECU 10 is programmed to determine whether or not the second accelerator operation section 42 has been operated. For example, the ECU 10 determines that the second accelerator operation section 42 has been operated when the second accelerator operation amount is equal to or more than a predetermined value. The predetermined value is not limited to zero and may be a value which is small enough that it is determined that there is no operation of the second accelerator operation section 42. When the second accelerator operation section 42 has not been operated, the process returns to the step S101. When the second accelerator operation section 42 has been operated, the process progresses to step S105.

In step 105, the ECU 10 is programmed to determine whether or not an engine rotation speed N is higher than a predetermined rotation speed Ne. It is preferable that a value, which filters the engine rotation speed that is detected by engine rotation speed sensor 43, be used as the engine rotation speed N. Thus, it is possible to use the engine rotation speed which corresponds to the boat speed in this determination. The engine rotation speed that is detected by the engine rotation speed sensor 43 may be used as the engine rotation speed N.

When the engine rotation speed N is equal to or more than the predetermined rotation speed Ne, the process progresses to step S106. When the engine rotation speed N is less than the predetermined rotation speed Ne, the process progresses to step S109. The process from step S106 and beyond includes a process to move the reverse gate 55 to the neutral position. On the other hand, the process from step S109 and beyond includes a process to move the reverse gate 55 to the reverse position. Accordingly, when the rotation speed of the engine is high, the process to move the reverse gate 55 to the neutral position is executed. When the engine rotation speed is low, a process to move the reverse gate 55 to the reverse position is executed. In other words, when the boat speed is fast, the process to move the reverse gate 55 to the neutral position is executed. When the boat speed is slow, the process to move the reverse gate 55 to the reverse position is executed.

In step S106, the ECU 10 sets the throttle opening ΘTHi. The ECU 10 sets the value from the smallest value out of "Θ2*i*" and a limit value β as the throttle opening ΘTHi. The limit value β is the limit value of the throttle opening when the reverse gate 55 is moved towards the neutral position. When "Θ2*i*" is smaller than the limit value β, "Θ2*i*" is set as throttle opening ΘTHi. Accordingly, the throttle opening is set according to the second accelerator operation amount. Here, the throttle opening is limited to the limit value β when "Θ2*i*" is equal to or more than the limit value β. Here, β is equal to or more than α described above. Due to this, the throttle opening is prevented from becoming excessively small. As a result, it is possible to significantly decrease or prevent a reduction in the response of the engine with regard to the accelerator operation.

In step S107, the GCU 11 moves the reverse gate 55 to the neutral position. For example, the GCU 11 moves the reverse gate 55 to the neutral position by receiving an instruction signal from the ECU 10 to move the reverse gate 55 to the neutral position. When the reverse gate 55 has arrived at the neutral position, the GCU 11 sends a signal to the ECU 10 which indicates that the reverse gate 55 has arrived at the neutral position.

In step S108, the ECU 10 gradually changes ΘTH from ΘTHi towards Θ2. For example, the ECU 10 changes ΘTH from ΘTHi towards Θ2 by units of δΘLmt every 10 ms. When the signal which indicates that the reverse gate 55 has arrived at the neutral position is received from the GCU 11, the ECU 10 gradually changes ΘTH from ΘTHi towards Θ2.

Accordingly, the throttle opening ΘTH is limited to the limit value β until the movement of the reverse gate 55 to the neutral position is complete when the throttle opening Θ2*i* is larger than the limit value β. Then, the ECU 10 gradually changes the throttle opening ΘTH to the throttle opening Θ2*i*, which corresponds to the current second accelerator operation amount, as the target opening when the movement to the neutral position of the reverse gate 55 is complete. Here, the throttle opening ΘTH is maintained at the throttle opening Θ2*i* when the throttle opening Θ2*i* is equal to or less than the limit value β.

When the engine rotation speed N is not equal to or more than the predetermined rotation speed Ne in step S105, the process progresses to step S109. In step S109, the ECU 10 is programmed to set the throttle opening ΘTHi. The ECU 10 sets the value from the smallest value out of "Θ2*i*" and a limit value γ as the throttle opening ΘTHi. The limit value γ is the limit value of the throttle opening when the reverse gate 55 is being moved towards the reverse position. When "Θ2*i*" is smaller than the limit value γ, "Θ2*i*" is set as the throttle opening ΘTHi. Accordingly, the throttle opening is set according to the second accelerator operation amount. Here, when "Θ2*i*" is equal to or more than the limit value γ, the throttle opening is limited to the limit value γ. Here, γ is equal to or more than α described above. Thus, the throttle opening is prevented from becoming excessively small. As a result, it is possible to significantly decrease or prevent a reduction in the response of the engine with regard to the accelerator operation.

In step S110, the GCU 11 moves the reverse gate 55 to the reverse position. For example, the GCU 11 moves the reverse gate 55 to the reverse position by receiving an instruction signal from the ECU 10 to move the reverse gate 55 to the reverse position. When the reverse gate 55 has arrived at the reverse position, the GCU 11 sends a signal which indicates that the reverse gate 55 has arrived at the reverse position to the ECU 10. Then, in step S108, the ECU 10 gradually changes ΘTH from ΘTHi to Θ2*i*.

As described above, the throttle opening ΘTH is limited by the limit value γ until the movement of the reverse gate 55 to the reverse position is complete when the throttle opening Θ2*i* is larger than the limit value γ. Then, the ECU 10 gradually changes the throttle opening ΘTH to the throttle opening Θ2*i*, which corresponds to the current second accelerator operation amount, as the target opening when the movement of the reverse gate 55 to the reverse position is complete. Here, the throttle opening ΘTH is maintained at the throttle opening Θ2*i* when the throttle opening Θ2*i* is equal to or less than the limit value γ.

In step S101, when the shift position is not "F", the process progresses to step S201 shown in FIG. 5. In step S201, the ECU 10 determines whether or not the shift position is "N". When the shift position is "N", the process progresses to step S202.

In step S202, the ECU 10 is programmed to set the throttle opening ΘTHi. The ECU 10 sets the value from the smallest value out of "Θ2", "ΘTHi−1+δΘLmt", and "XREVABS" as ΘTHi. "XREVABS" is the threshold for stabilizing control of the throttle opening. Accordingly, Θ2 is set as ΘTHi when Θ2 does not exceed "ΘTHi−1+δΘLmt" and "XREVABS". That is, the throttle opening is set according to the second accelerator operation amount. In addition, the limit values γ and β described above are smaller than "XREVABS".

In step S203, the ECU 10 determines whether or not the engine rotation speed N is equal to or more than the predetermined rotation speed Ne. It is preferable for the value, which filters the engine rotation speed that is detected by engine rotation speed sensor 43, to be used as the engine rotation speed N. Thus, it is possible to use an engine rotation speed which corresponds to the boat speed in this determination. Here, the engine rotation speed that is detected by the engine rotation speed sensor 43 may be used as the engine rotation speed N. When the engine rotation speed N is equal to or more than the predetermined rotation speed Ne, the process returns to step S101. When the engine rotation speed N is not equal to or more than the predetermined rotation speed Ne, the process progresses to step S204.

In step S204, the ECU 10 is programmed to determine whether or not there has been an operation of the second accelerator operation section 42. The process here is similar to the process in step S104. When the second accelerator operation section 42 has been operated, the process progresses to step S205. When the second accelerator operation section 42 has not been operated, the process progresses to step S206.

In step S205, the GCU 11 moves the reverse gate 55 into the reverse position. The process here is similar to the process in step S110. After this, the process returns to step S101.

In step S204, when the second accelerator operation section 42 has not been operated, the process progresses to step S206. In step S206, it is determined whether or not the first accelerator operation section 41 has been operated. For example, when the first accelerator operation amount is equal to or more than a predetermined value, the ECU 10 determines that the first accelerator operation section 41 has been operated. The predetermined value is not limited to zero and may be a small value which is small enough that it is seen that there is no operation of the first accelerator operation section 41. When the first accelerator operation section 41 has not been operated, the process returns to step S101. When the first accelerator operation section 41 has been operated, the process progresses to step S207.

In step S207, the ECU 10 is programmed to set the throttle opening ΘTHi. The ECU 10 sets the throttle opening ΘTHi as the largest value selected from the smallest value of the limit value E, "Θ1−Θ2", and zero. The limit value ϵ is the limit value of the throttle opening when the reverse gate 55 is being moved towards the forward position. Accordingly, "Θ1−Θ2" is set as ΘTHi when "Θ1−Θ2" does not exceed the limit value ϵ. Here, ΘTHi is set to zero when "Θ1−Θ2" is smaller than zero. When "Θ1−Θ2" is equal to or more than the limit value ϵ, the throttle opening is limited in the limit value ϵ. Further, ϵ is equal to or more than α described above. Thus, the throttle opening is prevented from becoming excessively small. As a result, it is possible to significantly decrease or prevent a reduction in the response of the engine with regard to the accelerator operation. Here, ϵ is smaller than XREVABS described above.

In step S208, the GCU 11 moves the reverse gate 55 to the forward position. For example, the GCU 11 moves the reverse gate 55 to the forward position by receiving an instruction signal from the ECU 10 to move the reverse gate 55 to the forward position. When the reverse gate 55 has arrived at the forward position, the GCU 11 sends a signal to the ECU 10 which indicates that the reverse gate 55 has arrived at the forward position.

In step S209, the ECU 10 gradually changes ΘTH from ΘTHi to "Θ1*i*−Θ2*i*". For example, the ECU 10 changes ΘTH from ΘTHi to "Θ1*i*−Θ2*i*" by units of δΘLmt every 10 ms. When the signal is received which indicates that the reverse gate 55 has arrived at the forward position from the GCU 11, the ECU 10 gradually changes ΘTH from ΘTHi to "Θ1*i*−Θ2*i*".

As described above, the throttle opening ΘTHi is limited to the limit value ϵ until movement of the reverse gate 55 to the forward position is complete when the throttle opening Θ2*i* is larger than the limit value ϵ. Then, the ECU 10 gradually changes the throttle opening ΘTH to the throttle opening "Θ1*i*−Θ2*i*", which corresponds to the current difference in the first accelerator operation amount and the second accelerator operation amount, as the target opening when the movement of the reverse gate 55 to the forward position is complete. Here, the throttle opening ΘTH is maintained at the throttle opening "$\Theta 1i-\Theta 2i$" when the throttle opening "$\Theta 1i-\Theta 2i$" is equal to or less than the limit value E.

In step S201 shown in FIG. 5, when the shift position is not "N", the process progresses to step S301 shown in FIG. 6.

In step S301, the ECU 10 is programmed to set the throttle opening ΘTHi. The ECU 10 sets the value from the smallest value out of "Θ2", "ΘTHi−1+δΘLmt", and "XREVABS" as ΘTHi. The process here is similar to the process in step S202.

In step S302, the ECU 10 determines whether or not the second accelerator operation section 42 has been operated. The process here is similar to the process in step S104. When the second accelerator operation section 42 has been operated, the process returns to step S101. When the second accelerator operation section 42 has not been operated, the process progresses to step S303.

In step S303, it is determined whether or not the first accelerator operation section 41 has been operated. The individual processes are similar to the processes in step S206. When the first accelerator operation section 41 has been operated, the process progresses to step S304. When the first accelerator operation section 41 has not been operated, the process progresses to step S307.

In step S304, the ECU 10 sets the throttle opening ΘTHi. The ECU 10 sets the value from the largest value selected from the smallest value of the limit value ϵ, "Θ1−Θ2", and zero as the throttle opening ΘTHi. The process here is similar to the process in step S207.

In step S305, the GCU 11 moves the reverse gate 55 to the forward position. The process here is similar to the process in step S208.

In step S306, the ECU 10 gradually changes ΘTH from ΘTHi to "$\Theta 1i-\Theta 2i$". The process here is similar to the process in step S209.

As described above, the ECU 10 moves the reverse gate 55 from the reverse position to the forward position when the second accelerator operation section 42 has not been operated and the first accelerator operation section 41 has been operated.

In step S303, when the first accelerator operation section 41 has not been operated, the process progresses to step S307. In step S307, the ECU 10 determines whether or not a predetermined waiting time has elapsed. When the predetermined wait time has not elapsed, the process returns to step S101. When the predetermined wait time has elapsed, the process progresses to step S308.

In step S308, the ECU 10 is programmed to set the throttle opening ΘTHi. The ECU 10 sets the value from the smallest value out of "Θ2*i*" and the limit value β as the throttle opening ΘTHi. The process here is similar to the process in step S106.

In step S309, the GCU 11 moves the reverse gate 55 to the neutral position. The process here is similar to the process in step S107.

As described above, when neither the first accelerator operation section 41 nor the second accelerator operation section 42 has been operated, the ECU 10 moves the reverse gate from the reverse position to the neutral position when the predetermined wait time has elapsed. That is, when the first accelerator operation section 41 and the second accelerator operation section 42 have not changed in the state of having not been operated for the predetermined wait time or more, the ECU 10 moves the reverse gate 55 from the reverse position to the neutral position.

In step S310, the ECU 10 gradually changes ΘTH from ΘTHi to Θ2*i*. The process here is similar to the process in step S108.

Description of the actions of the jet propulsion boat 100 due to the speed reduction control described above is as follows.

When the operator operates the second accelerator operation section 42 so that Θ1−Θ2≥0 when the water jet propulsion boat 100 advances forward with a fast boat speed, the reverse gate 55 automatically changes from the forward position to the neutral position (S107). Thus, the speed of the water jet propulsion boat 100 is reduced. Then, it is possible to obtain a speed reduction power according to the second accelerator operation amount (S108). Then, the reverse gate 55 is changed automatically from the neutral position to the reverse position if the boat speed is slow (S205). Thus, the speed of the water jet propulsion boat 100 is further reduced, and after that, the water jet propulsion boat 100 reverses. At this time, it is possible to obtain a speed reduction power or a backward propulsion power according to the second accelerator operation amount (S301). Here, the reverse gate 55 is changed from the forward position to the neutral position and then from the neutral position to the reverse position with the operator having operated the second accelerator operation section 42 without having performed the operation of returning the second accelerator operation section 42 to the initial position.

When the water jet propulsion boat 100 advances forward at a slow boat speed, the reverse gate 55 automatically changes from the forward position to the reverse position when the second accelerator operation section 42 is operated so that Θ1−Θ2≥0 (S110). Thus, the speed of the water jet propulsion boat 100 is reduced. At this time, it is possible to obtain a speed reduction power according to the second accelerator operation amount (S108).

When the operator returns the second accelerator operation section 42 to the initial position when the reverse gate 55 is in the neutral position or the reverse position and the first accelerator operation section has been operated, the reverse gate 55 is changed to the forward position (S205, S304). In other words, the reverse gate 55 is not changed to the forward position even if the first accelerator operation section 41 has been operated unless the operator returns the second accelerator operation section 42 to the initial position when the reverse gate 55 is in the neutral position or the reverse position.

As described above, in the water jet propulsion boat 100 according to the present preferred embodiment, the ECU 10 is programmed to set the position of the reverse gate 55 and the throttle opening of the engine 3 based on the first accelerator operation amount and the second accelerator operation amount. As a result, it is possible to obtain a natural speed reduction performance according to the operation amount of the second accelerator operation section 42.

When the reverse gate 55 is positioned in the forward position, the ECU 10 sets the throttle opening according to a value which corresponds to the difference between the first accelerator operation amount and the second accelerator operation amount. Thus, natural driving of the boat according to the intention of the operator is possible compared to the intention of the operator to move forward or the intention of the operator to reverse.

When the difference between the first accelerator operation amount and the second accelerator operation amount is smaller than α, the ECU 10 is programmed to move the reverse gate 55 from the forward position to the reverse position or to the neutral position. Thus, it is possible to obtain a speed reduction power which is larger than the speed reduction power when the throttle opening is set to zero. In addition, it is possible to avoid erroneous actions of the reverse gate 55 since the operation of the reverse gate 55 is performed in a case in which the operator has operated the second accelerator operation section 42 to a larger extent.

The ECU 10 is programmed to selectively move the reverse gate 55 to the neutral position or to the reverse position according to the rotation speed of the engine when the difference between the first accelerator operation amount and the second accelerator operation amount become smaller than α. As a result, the reverse gate 55 moves to the neutral position and not to the reverse position when the boat speed is high. Thus, it is possible to stabilize the motions of the boat body 2.

When the difference between the first accelerator operation amount and the second accelerator operation amount is smaller than the predetermined value α and the second accelerator operation section 42 has been operated, the ECU 10 moves the reverse gate 55 from the forward position to the reverse position or to the neutral position. Thus, it is possible for an intention of the operator to reduce the speed and an intention of the operator to reverse to be precisely detected and for the reverse gate 55 to be operated accordingly.

When the reverse gate 55 is being moved, the ECU 10 limits the throttle opening to be equal to or less than the predetermined limit values β, γ or ϵ. Then, after the reverse gate 55 has arrived at a positioned which is the target position, the ECU 10 is programmed to change the throttle opening while limiting the amount of one incremental change to the predetermined amount so that the throttle opening is a predetermined target opening. Thus, it is possible to significantly reduce or prevent changes in the motions of the boat body 2 due to sudden changes to the throttle opening.

Instead of directly detecting the boat speed of the boat body 2, the ECU 10 is programmed to approximate the rotation speed of the engine. As a result, a sensor to detect the boat speed is unnecessary. Thus, it is possible to reduce production costs.

The ECU 10 is programmed to determine the movement of the reverse gate 55 based on the first accelerator operation amount and the second accelerator operation amount. Thus, it is possible for the intention of the operator to reduce the speed, the intention of the operator to reverse, and the intention of the operator to advance to be precisely detected and for the reverse gate 55 to be operated accordingly. In addition, the ECU 10 determines the movement of the reverse gate 55 based on the rotation speed of the engine. Thus, it is possible for the motions of the boat body 2 after operation to be stabilized.

Preferred embodiments of the present invention have been described above, but the present invention is not limited to the preferred embodiments described above and various modifications are possible within the scope which does not depart from the gist of the present invention.

In the preferred embodiments described above, the PWC is given as a non-limiting example of the water jet propulsion boat, but the present invention may be applied to other water jet propulsion boats such as jet boats.

In the preferred embodiments described above, in the determinations in steps S105 and S203, an approximate number of engine rotations preferably is used instead of the boat speed, but the boat speed may be used. The boat speed may be calculated using the rotation speed of the engine or the boat speed may be detected using sensors such as GPS or Pitot tubes. Alternatively, as described above, the boat speed may be substituted by applying a filter to the rotation speed of the engine.

In the preferred embodiments described above, in order to reduce the speed of the boat body 2, both of the positions of the reverse position and the neutral position of the reverse gate 55 are preferably used, but either one of the reverse position or the neutral position may be used, for example.

The reverse gate 55 may be configured so that the orientation of the jets from the jet propulsion mechanism 5 in the neutral position changes to the front of the boat body 2 or downward and is not limited to only to the left and right of the boat body 2.

In the preferred embodiments described above, the target opening after the reverse gate 55 has arrived at the reverse position or the neutral position preferably is the throttle opening Θ2 which corresponds to the current second accelerator operation amount, but the target opening may be other values. For example, the target opening may be the throttle opening Θ1 which corresponds to the current first accelerator operation amount. Alternatively, the target opening may be the throttle opening "Θ1−Θ2" which corresponds to the current difference in the first accelerator operation amount and the second accelerator operation amount.

In the preferred embodiments described above, the ECU and the GCU both are preferably provided, but one controller which is programmed to perform both the functions of the ECU and the GCU may be provided.

In the preferred embodiments described above, a lever is given as a non-limiting example of the first accelerator operation section but a member other than a lever may be used. For example, a pedal, a grip, a switch or the like may be used as the first accelerator operation section. In the preferred embodiments described above, a lever is given as a non-limiting example of the second accelerator operation section but a member other than a lever may be used. For example, a pedal, a grip, a switch or the like may be used as the second accelerator operation section.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A water jet propulsion boat comprising:

a boat body;

an engine accommodated in the boat body;

a jet propulsion mechanism configured to generate a propulsion power using a drive power from the engine;

a first accelerator operation section;

a second accelerator operation section;

a reverse gate configured to move to a first position in which the boat body advances forward and a second position in which the propulsion power which advances the boat body forward is reduced; and a control section programmed to determine a position of the reverse gate and a throttle opening of the engine based on a difference between an operation amount of the first accelerator operation section and an operation amount of the second accelerator operation section.

2. The water jet propulsion boat according to claim 1, wherein the control section is programmed to determine the throttle opening as a value which corresponds to the difference between the operation amount of the first accelerator operation section and the operation amount of the second accelerator operation section when the reverse gate is in the first position.

3. The water jet propulsion boat according to claim 2, wherein the control section is programmed to move the reverse gate to the second position when the difference in the operation amount of the first accelerator operation section and the operation amount of the second accelerator operation section is smaller than a predetermined value.

4. The water jet propulsion boat according to claim 3, wherein the second position is a neutral position or a reverse position, and the control section is programmed to selectively move the reverse gate to the neutral position or to the revere position based on a speed of the boat body when the difference in the operation amount of the first accelerator operation section and the operation amount of the second accelerator operation section is smaller than the predetermined value.

5. The water jet propulsion boat according to claim 4, wherein, when the difference in the operation amount of the first accelerator operation section and the operation amount of the second accelerator operation section is smaller than the predetermined value, the control section is programmed to move the reverse gate to the reverse position when the speed of the boat body is less than a predetermined speed and the second accelerator operation section has been operated.

6. The water jet propulsion boat according to claim 5, wherein, when the difference in the operation amount of the first accelerator operation section and the operation amount of the second accelerator operation section is smaller than the predetermined value, the control section is programmed to move the reverse gate to the neutral position when the speed of the boat body is equal to or more than the predetermined speed and the second accelerator operation section has been operated.

7. The water jet propulsion boat according to claim 3, wherein the control section is programmed to limit the throttle opening to equal to or less than a predetermined limit value during movement of the reverse gate, and to change the throttle opening while limiting the amount of one incremental change to a predetermined amount so that the throttle opening is a predetermined target opening after the reverse gate has arrived at the second position.

8. The water jet propulsion boat according to claim 7, wherein the target opening is a value which corresponds to a current operation amount of the second accelerator operation section.

9. The water jet propulsion boat according to claim 7, wherein the target opening is a value which corresponds to a current operation amount of the first accelerator operation section.

10. The water jet propulsion boat according to claim 7, wherein the target opening is a value which corresponds to the difference between a current operation amount of the first accelerator operation section and a current operation amount of the second accelerator operation section.

11. The water jet propulsion boat according to claim 4, further comprising:

a rotation speed detection section configured to detect a rotation speed of the engine; wherein the control section is programmed to calculate the speed of the boat body based on the rotation speed of the engine.

12. The water jet propulsion boat according to claim 4, wherein the control section is programmed to move the reverse gate to the reverse position when the reverse gate is at the neutral position, the second accelerator operation section has been operated, and the speed of the boat body is less than a predetermined speed.

13. The water jet propulsion boat according to claim 4, wherein the control section is programmed to move the reverse gate to a forward position when the reverse gate is at the neutral position, the first accelerator operation section has been operated, and the second accelerator operation section has not been operated.

14. The water jet propulsion boat according to claim 4, wherein the control section is programmed to move the reverse gate to the neutral position when the reverse gate is at the reverse position and the operation amount of the first accelerator operation section and the operation amount of the second accelerator operation section have not changed for a predetermined time period or more.

15. The water jet propulsion boat according to claim 4, wherein the control section is programmed to move the reverse gate to the forward position when the reverse gate is at the reverse position, the first accelerator operation section has been operated, and the second accelerator operation section has not been operated.

16. A water jet propulsion boat comprising:

a boat body;

an engine accommodated in the boat body;

a jet propulsion mechanism configured to generate a propulsion power using a drive power from the engine;

a first accelerator operation section;

a second accelerator operation section;

a reverse gate configured to move to a first position in which the boat body advances forward and a second position in which the propulsion power which advances the boat body forward is reduced; and a control section programmed to determine a position of the reverse gate and a throttle opening of the engine based on an operation amount of the first accelerator operation section and an operation amount of the second accelerator operation section when the first accelerator operation section and the second accelerator operation section are operated simultaneously.

17. The water jet propulsion boat according to claim 1, wherein, when the reverse gate is in the first position, the control section is programmed to set the position of the reverse gate and the throttle opening of the engine based on the operation amount of the first accelerator operation section and the operation amount of the second accelerator operation section.

* * * * *